US005247871A

United States Patent [19]

Brasca et al.

[11] Patent Number: 5,247,871

[45] Date of Patent: Sep. 28, 1993

[54] COMBINED PNEUMATIC-HYDRAULIC PRESS HEAD WITH HIGH ACTUATION SPEED

[76] Inventors: Carlo Brasca; Daniele Brasca, both of Via Puccini 13, 20085 Locate Di Triulzi (Province of Milano), Italy

[21] Appl. No.: 838,179

[22] Filed: Feb. 20, 1992

[30] Foreign Application Priority Data

Feb. 28, 1991 [IT] Italy ..... 000523 A/91

[51] Int. Cl.[5] ..... F15B 11/00

[52] U.S. Cl. ..... 91/519; 91/520; 60/560; 60/565; 60/593

[58] Field of Search ..... 92/61; 91/4 R, 519, 91/520, 525, 535; 60/560, 563, 565, 593

[56] References Cited

U.S. PATENT DOCUMENTS

| | | | |
|---|---|---|---|
| 3,059,433 | 10/1962 | Hirsch | 60/565 |
| 3,266,415 | 8/1966 | Palmer | 60/593 |
| 3,875,365 | 4/1975 | Beneteau | 60/560 |
| 4,072,013 | 2/1978 | Barbareschi | 60/565 |
| 4,288,987 | 9/1981 | Grullmeier | 60/593 |
| 4,300,351 | 11/1981 | Grullmeier | 60/563 |
| 4,422,294 | 12/1983 | Klein | 60/593 |
| 4,961,317 | 10/1990 | Wolfbauer . | |

FOREIGN PATENT DOCUMENTS

| | | | |
|---|---|---|---|
| 0023030 | 1/1981 | European Pat. Off. . | |
| 0355780 | 2/1990 | European Pat. Off. . | |
| 2017007 | 10/1971 | Fed. Rep. of Germany . | |
| 995204 | 11/1951 | France . | |
| 2384977 | 10/1978 | France . | |
| 2535796 | 5/1984 | France | 60/560 |
| 2175648 | 12/1986 | United Kingdom . | |

*Primary Examiner*—Thomas E. Denion
*Attorney, Agent, or Firm*—Guido Modiano; Albert Josif

[57] ABSTRACT

The combined pneumatic-hydraulic press head includes a body inside which a substantially cylindrical main chamber is defined; the chamber accommodates a main piston and a secondary piston so that they can slide along an axial direction. The main piston has a stem which protrudes from an axial end of the main chamber, and the secondary piston is spaced from the main piston on the side opposite to the stem. The two pistons sealingly divide the main chamber into three chambers: two end chambers, which can be connected to a source of compressed air or to the atmosphere in order to move the two pistons along the axis of the main chamber during the approach of the main stem or spacing motion with respect to the part to be treated, and an intermediate chamber which contains a liquid. An actuation stem is furthermore accommodated in the main chamber and sealingly passes through the secondary piston. A partition is arranged in the intermediate chamber, is rigidly fixed to the walls of the main chamber and is crossed by a passage for the actuation stem. The press is actuated by pushing the actuation stem through the passage toward the main piston so as to increase the pressure in the region of the intermediate chamber which is located between the main piston and the partition.

8 Claims, 3 Drawing Sheets

COMBINED PNEUMATIC-HYDRAULIC PRESS HEAD WITH HIGH ACTUATION SPEED

BACKGROUND OF THE INVENTION

The present invention relates to a combined pneumatic-hydraulic press head with high actuation speed.

Mechanically actuated presses, hydraulically actuated presses and presses with combined pneumatic-hydraulic actuation are known. The latter type of press is becoming increasingly widespread on the market, since its particular actuation method, by requiring only the use of compressed air, allows significant advantages with respect to presses with exclusively hydraulic actuation.

Presses with combined pneumatic-hydraulic actuation generally comprise a head which is constituted by a substantially cylindrical body in which a main cylindrical chamber is defined; a main piston is axially slidingly accommodated in said chamber and its stem protrudes from one side of the head. This stem constitutes the element of the press which, associated with various types of tools, performs the various treatments for which presses are normally used, such as for example clamping, blanking, marking, straightening, riveting, calking, coining, bending, drawing, keying, etc.

The main chamber can be selectively connected, on opposite sides with respect to the main piston, to a source of compressed air or to the atmosphere so as to rapidly move, with a reduced force, the stem toward or away from the working surface on which the part to be treated is arranged.

In order to actuate the main piston with an adequate force during the actual working step, the main piston generally has a wing which extends on the opposite side with respect to the stem and can slide in a liquid-filled chamber.

Said liquid-containing chamber has a narrower portion in which the stem of another pneumatically-actuated piston can slide sealingly. The assembly constituted by the liquid-containing chamber, by the wing of the main piston and by the stem of said pneumatically-actuated piston constitutes a hydraulic press in which the actuation force of the stem which slides in the narrower portion of the liquid-containing chamber is multiplied and transmitted to the main piston in order to obtain an adequate force during the working step.

These types of presses with combined pneumatic-hydraulic actuation, despite having undeniable advantages with respect to presses with exclusively hydraulic actuation, have some problems.

Since the main piston is conceived like the piston of a double-action pneumatic cylinder, during the rapid approach step said main piston in fact draws the liquid contained in the chamber in which the wing which constitutes an element of the hydraulic press slides. This drawing action, allowed by a compensation element which sends liquid into said chamber or keeps its volume constant by means of another sliding piston which delimits the chamber on the side opposite to said wing, exerts a braking effect on the main piston, reducing its speed of approach to the part to be treated or requiring greater pneumatic power in order to obtain the required speed. Furthermore, the filling of the chamber of the liquid by drawing is never assured and complete in short time periods.

In some types of presses, in which the compensation element is constituted by a tank of liquid connected to the hydraulic press chamber, pneumatic pressurization of the tank reduces this effect but unavoidably makes the construction of the press more complicated and entails a reduction in the pressing hydraulic area.

SUMMARY OF THE INVENTION

The aim of the present invention is to obviate the above described problems by providing a head of a press with combined pneumatic-hydraulic actuation which has high speeds of approach or spacing with respect to the part to be treated with reduced actuation power and with an easily executable structure.

Within the scope of this aim, an object of the invention is to provide a press head which, by virtue of the reduction in the time required during the steps of approach and spacing with respect to the part, has a high productive potentiality.

Another object of the invention is to provide a press head which in addition to great simplicity in execution can have a reduced bulk with respect to conventional combined pneumatic-hydraulic presses of equal power.

This aim, these objects and others which will become apparent hereinafter are achieved by a combined pneumatic-hydraulic press head with high actuation speed, characterized in that it comprises a body which internally defines a substantially cylindrical main chamber which accommodates a main piston and a secondary piston so that they can slide along an axial direction, said main piston having a stem which protrudes from an axial end of said main chamber, said secondary piston being spaced from said main piston on the opposite side with respect to said stem, said pistons sealingly dividing said main chamber into three chambers: two end chambers, arranged respectively between said pistons and the axial ends of said main chamber, and an intermediate chamber which is located between said pistons and is filled with a liquid, said end chambers being connectable to a source of compressed air or to the atmosphere in order to move said pistons along the axis of said main chamber, said main chamber furthermore accommodating an actuation stem which axially sealingly passes through said secondary piston and can move axially along said main chamber, a partition being provided in said intermediate chamber and being rigidly connected to said body, a passage being defined in said partition, said actuation stem being able to pass sealingly through said passage in order to vary the pressure in the region of said intermediate chamber which is delimited by said main piston and by said partition.

BRIEF DESCRIPTION OF THE DRAWINGS

Further characteristics and advantages of the invention will become apparent from the description of a preferred but not exclusive embodiment of a press head according to the invention, illustrated only by way of non-limitative example in the accompanying drawings, wherein.

DESCRIPTION OF THE PREFERRED EMBODIMENTS

Figure 1:
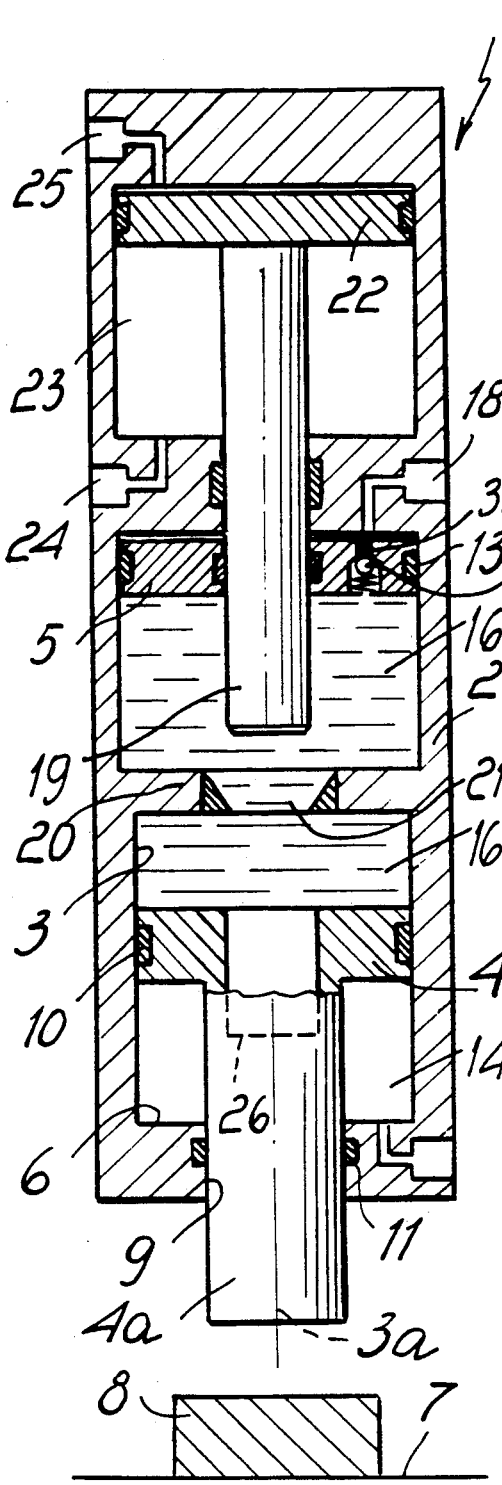
FIG. 1 is a schematic axial sectional view of the press head according to the invention when idle.
Figure 2:
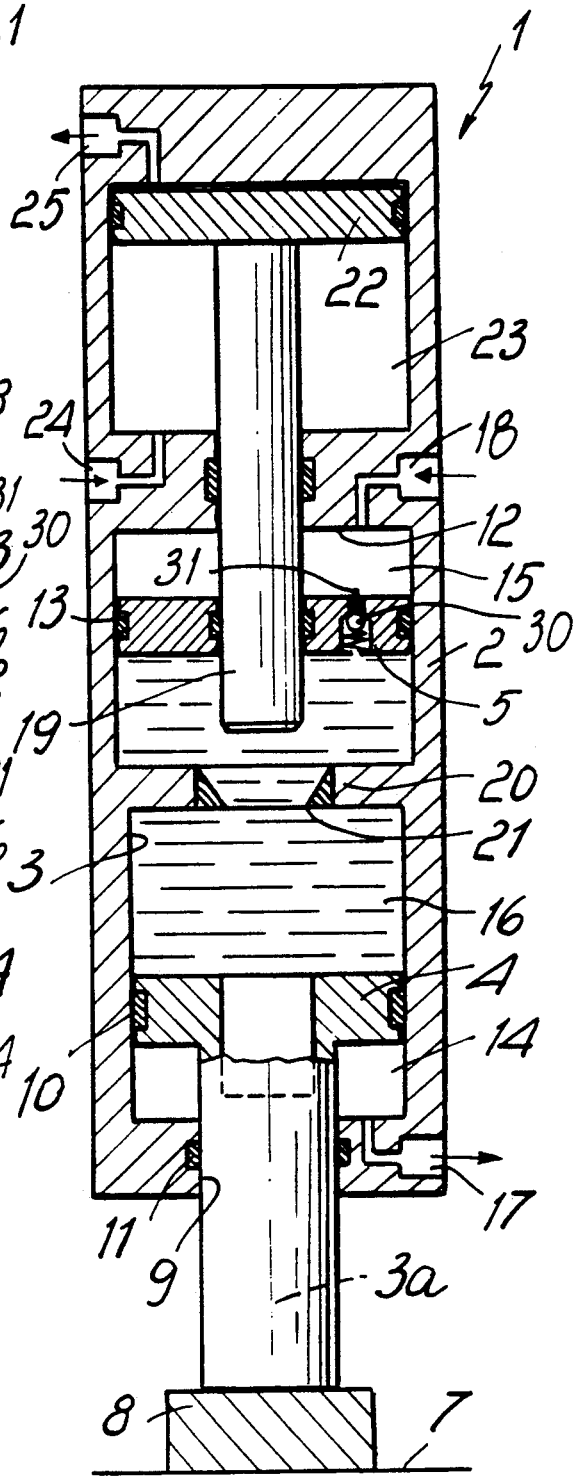
FIG. 2 is a sectional view of the press head, taken similarly to FIG. 1, during the step of rapid approach to the part to be treated.
Figure 3:
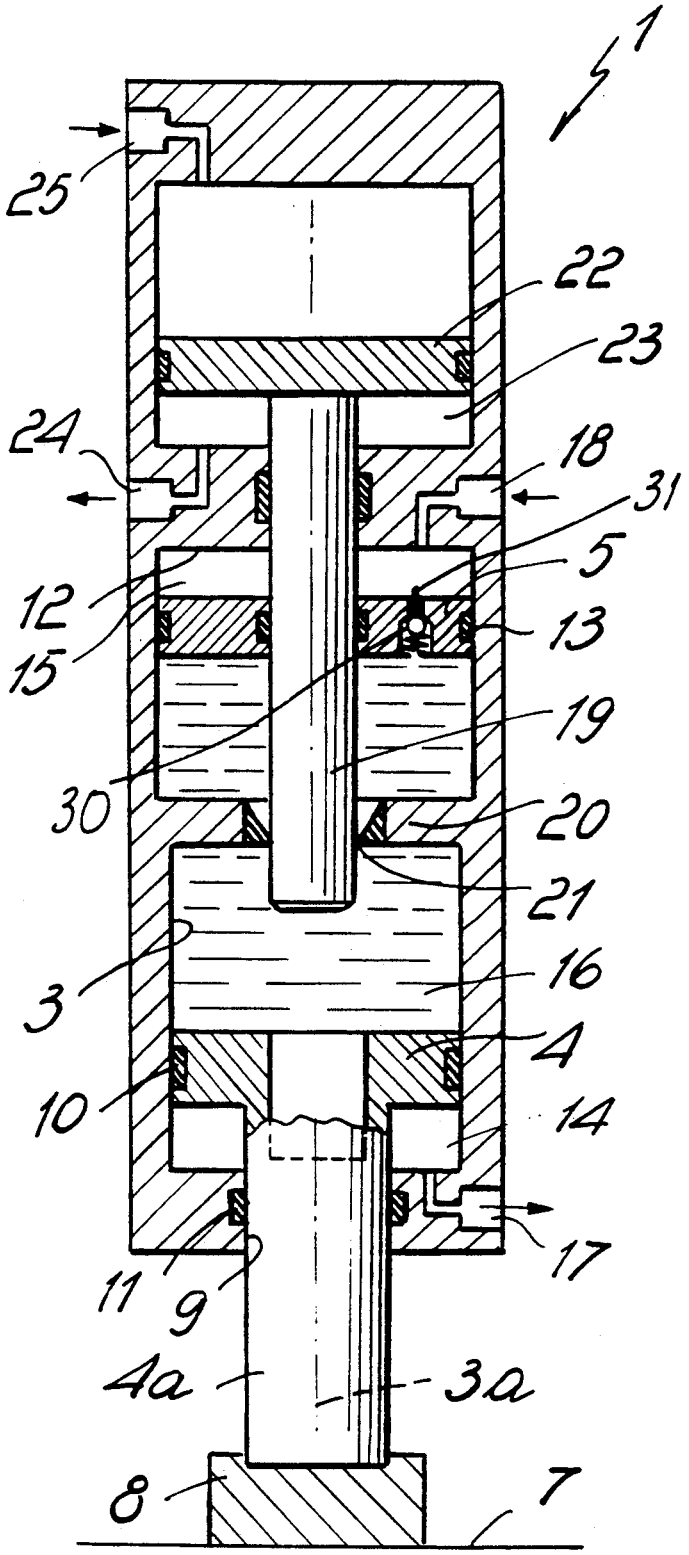
FIG. 3 is a sectional view of the press head, taken similarly to FIG. 1, during the working step.

With reference to FIGS. 1 to 3, the press head according to the invention, generally designated by the reference numeral 1, comprises a body 2 inside which a substantially cylindrical main chamber 3 is defined; said main chamber accommodates, so that they can slide along its axis 3*a*, a main piston 4 and a secondary piston 5 which is spaced from the main piston 4 along the axis 3*a*.

The main piston 4 is arranged proximate to an axial end 6 of the main chamber 3 and is provided with a stem 4*a* which protrudes from said axial end 6 and faces the working surface 7 of the press on which the parts 8 to be subjected to the action of the press are arranged.

Sealing gaskets, respectively designated by the reference numerals 10 and 11, are provided on the main piston 4 and on a passage 9 of the end 6 of the chamber 3 through which the stem 4*a* protrudes.

The secondary piston 5 is arranged proximate to the other axial end 12 of the main chamber 3 and is also provided with a sealing gasket 13 which rests against the walls of the chamber 3.

The main piston 4 and the secondary piston 5 divide the chamber 3 into three chambers: two end chambers 14 and 15, respectively defined between the main piston 4 and the axial end 6 of the chamber 3 and between the secondary piston 5 and the axial end 12 of the chamber 3, and an intermediate chamber 16 which is axially delimited by the two pistons 4 and 5.

The end chambers 14 and 15 can be selectively connected, through ports 17 and 18, to sources of compressed air or to the atmosphere in order to obtain the reciprocating motion of the pistons 4 and 5 along the axis 3*a*, whereas the intermediate chamber 16 is filled with liquid.

Alternatively, the return motion of the main piston 4 can be obtained, instead of by connecting the port 17 to a source of compressed air, by means of a spring which is arranged in the chamber 14 and acts on the piston 4.

An actuation stem 19 is furthermore located in the main chamber 3, sealingly passes through the secondary piston 5 and can move parallel to the axis 3*a* in order to increase the pressure in the intermediate chamber 16.

A partition 20 is provided in the intermediate chamber 16, is rigidly associated with the body 2 and has a passage 21 through which the actuation stem 19 can sealingly pass in order to vary the pressure in the lower region of the intermediate chamber 16 which is delimited axially by the main piston 4 and by the partition 20, as will become apparent hereinafter.

The actuation stem 19 is connected to an actuation piston 22 which can slide inside an actuation chamber 23 which is also defined in the body 2 and is arranged in the region of the axial end 12 of the main chamber 3. Said chamber 23 is sealingly separated from the chamber 3 and can be selectively connected, through ports 24 and 25 arranged on opposite sides with respect to the actuation piston 22, to a source of compressed air or to the atmosphere in order to move the piston 22 with a reciprocating motion parallel to the axis 3*a*.

Alternatively, the return of the actuation piston 22 can also be obtained, instead of by connecting the port 24 to a source of compressed air, by means of a spring which is accommodated in the chamber 23 and acts on the piston 22.

Conveniently, the main chamber 3 and the actuation chamber 23 have a cylindrical configuration and are arranged coaxially with respect to one another, and the pistons 4, 5 and 22 and the stems 4*a* and 19 are also arranged coaxially with respect to one another and with respect to the chambers 3 and 23.

Advantageously, a depression 26 is defined on the face of the main piston 4 which faces the actuation stem 19 and can loosely accommodate the end of the actuation stem 19.

It should be noted that the press head illustrated in FIGS. 1 to 3 can be arranged, according to the requirements, so that its axis 3*a* is vertical, horizontal or inclined.

If use with the axis 3*a* arranged exclusively vertically is intended, the secondary piston 5 can be omitted or replaced by labyrinths or the like without changing the other elements which compose the press head. In an embodiment of this type, the main piston 4 divides the main chamber 3 into two chambers: a first chamber which corresponds to the end chamber 14 as already described, and a second chamber which is arranged between the main piston 4 and the axial end 12 of the chamber 3. Said second chamber contains a liquid whose free surface extends between the partition 20 and the inlet 18 during the movement of the main piston 4. In this case, any accidental leakages of air from the chamber 14 to the liquid rise toward the free surface of the liquid without altering the correct operation of the press.

The press head according to the invention can obviously be provided with the secondary piston 5 even if it is arranged so that the axis 3*a* is vertical. In this case, the secondary piston 5 can be provided with valve means to vent any air present in the liquid contained in the intermediate chamber 16. Said valve means can be simply constituted by a check valve 30 provided with a needle 31 which protrudes from the secondary piston 5 from its side directed toward the axial end 12 of the main chamber 3 and is opened by virtue of the contact of said needle 31 against the axial end 12 when the secondary piston 5 is at the end of its return stroke.

Figure 4:
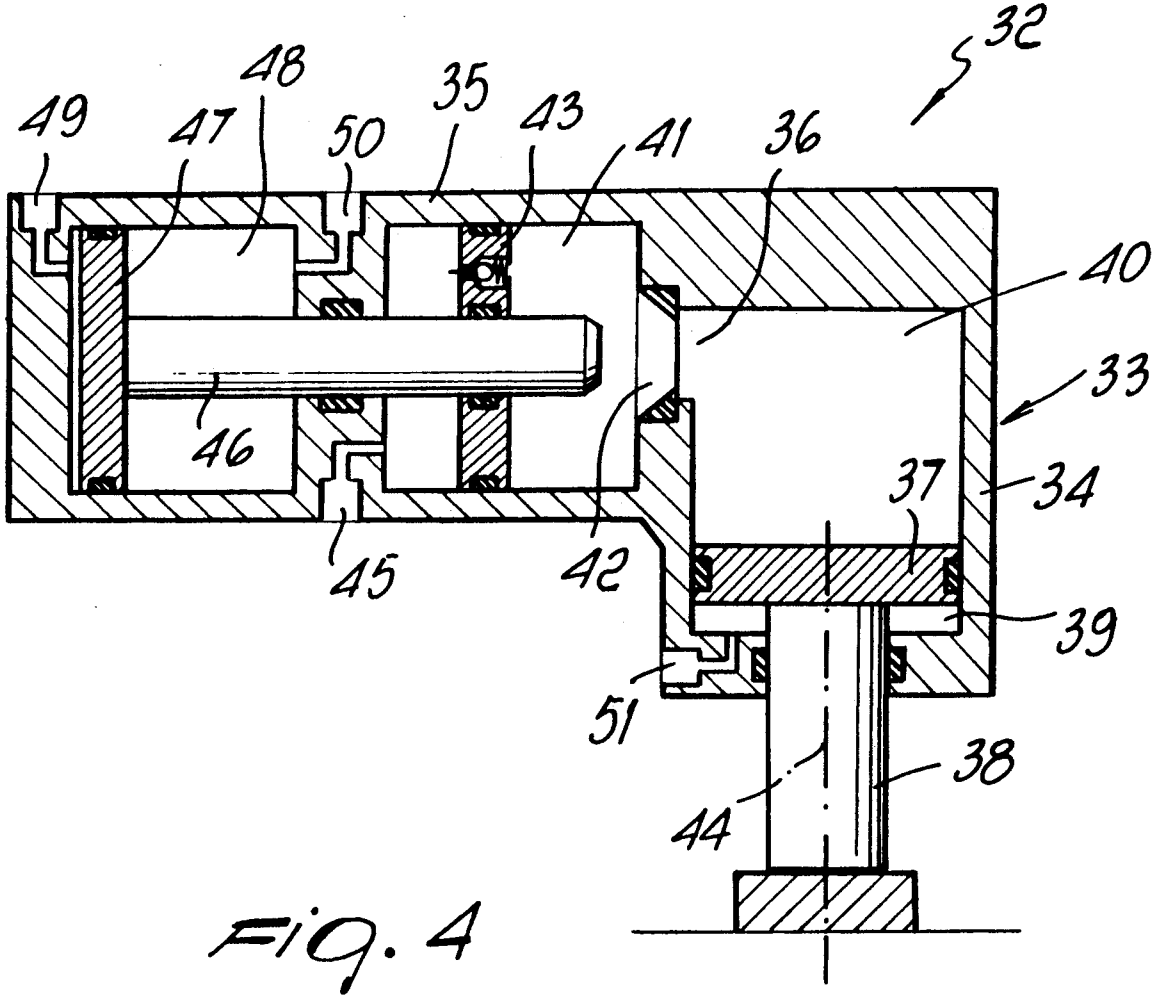
FIG. 4 is a schematic axial sectional view of the press head according to a further aspect of the present invention.

FIG. 4 illustrates the press head according to a further aspect of the present invention. According to this further aspect, the press head, generally designated by the reference numeral 32, comprises a body 33 which is constituted b two portions 34 and 35 which extend transversely to one another. In this case, the main chamber 36 extends partly in the first portion 34 and partly in the second portion 35 of the body 33.

More particularly, the part of the main chamber 36 which is defined in the portion 34 slidingly accommodates a main piston 37 which is provided with a stem 38 which protrudes from the first portion 34 of the body 33. The main piston 37 divides the main chamber 36 into two chambers: a first chamber 39, which is arranged between the main piston 37 and the end of the first portion 34 from which the stem 38 protrudes, and a second chamber which is filled with a liquid which is in contact with the face of the main piston 37 which is opposite with respect to the stem 38. The second chamber is divided into two compartments 40 and 41 which are mutually connected by means of a passage 42: a first compartment 40, which is defined in the portion 34 and is delimited by the main piston 37 on one side, and a second compartment 41, which is defined in the portion 35 and is delimited, on one side, by a secondary piston 43 which can slide along a direction which is transverse to the axis 44 of the main piston.

The part of the second compartment 41 which is sealingly separated from the liquid by means of the secondary piston 43 can be connected, through an inlet 45, to a source of compressed air or to the atmosphere so as to cause the passage of at least part of the liquid contained in the second compartment 41 into the first compartment 40 in order to axially move the main piston 37.

Cutoff means are provided on the passage 42 in order to sealingly isolate the first compartment 40 from the second compartment 41.

More particularly, said cutoff means are constituted by the stem 46 of an actuation piston 47 which is arranged so that its axis is transverse to the axis 44 and can be sealingly inserted through the passage 42 so as to enter the first compartment 40 in order to increase the hydraulic pressure inside the first compartment, with a consequent increase in the actuation force which acts on the main piston 37 parallel to the axis 44.

More particularly, the stem 46, besides sealingly passing through the passage 42, also sealingly passes through the secondary piston 43.

The actuation piston 47 can be simply constituted by a pneumatically actuated piston which can slide inside a chamber 48 which can be connected, through ports 49 and 50 arranged on opposite sides with respect to the actuation piston 47, to a source of compressed air or to the atmosphere so as to cause the axial movement of the actuation piston 47 in one direction or the other.

The return stroke of the main piston 37 can be obtained by connecting the first chamber 39 to a source of compressed air, through a port 51, or by means of a spring interposed between the main piston 37 and the wall of the body 33 from which its stem 38 protrudes.

If the axis of the second compartment 41 is arranged vertically, the secondary piston 43 may obviously be omitted in this embodiment as well. Alternatively, as already described with reference to the embodiment illustrated in FIGS. 1 to 3, the secondary piston 43 can be provided with valve means for venting any air included in the liquid contained in the second chamber between the main piston 37 and the secondary piston 43.

The operation of the press head according to the invention is now described with reference to the embodiment illustrated in FIGS. 1 to 3.

The press head in idle condition is as shown in FIG. 1.

In order to actuate the press head, the port 17 is vented, i.e. connected to the atmosphere, and the port 18 is connected to a source of compressed air, whereas the port 24 is also connected to a source of compressed air and the port 25 is kept connected to the atmosphere (FIG. 2).

The connections thus performed cause the rapid movement of the main piston 4 and thus of its stem 4*a* and of the piston 5 toward the working surface 7, whereas the actuation piston 22 is kept motionless. It should be noted that during this step, contrary to what occurs in known combined pneumatic-hydraulic presses, the liquid contained in the intermediate chamber 16 is not drawn by the movement induced by the main piston 4 but is moved together with the piston 4 by means of the movement of the secondary piston 5, which acts directly on the liquid. A greater advancement speed of the stem 4*a* toward the part 8 is thus obtained with an equal amount of pneumatic power used, since no braking action of the liquid on the main piston 4 occurs.

When the stem 4*a* has reached the part 8, the connections of the ports 24 and 25 are reversed, i.e. the port 24 is connected to the atmosphere and the port 25 is connected to a source of compressed air.

In this manner the actuation piston 22 is moved toward the main piston 4 and the actuation stem 19 is thus moved forward in the intermediate chamber 16 which contains liquid (FIG. 3).

The advancement of the actuation stem 19 causes an increase in the pressure inside the intermediate chamber 16, which is compensated by a return movement of the secondary piston 5 until the actuation stem enters the passage 21 defined in the partition 20. Once this entry has occurred, the further advancement of the actuation stem 19 toward the main piston 4 produces a pressure increase only in the portion of the intermediate chamber 16 which is located between the partition 20 and the main piston 4. In this manner, the press head operates like a hydraulic press and the pressure increase determined by the advancement of the actuation stem 19 is discharged onto the main piston 4 and thus onto its stem 4*a*, which performs the treatment of the part 8.

If a long stroke of the actuation piston 22 is required, the stem 19 can enter the recess 26 appropriately provided in the main piston 4.

Once treatment has ended, the connections of the ports 24 and 25 are reversed again in order to reverse the movement of the piston 22 and the connections of the ports 17 and 18 are subsequently reversed in order to move the stem 4 away from the treated part 8.

At this point the cycle resumes as already described.

The operation of the press head illustrated in FIG. 4 is similar to the one described with reference to the embodiment illustrated in FIGS. 1 to 3.

In practice it has been observed that the press head according to the invention fully achieves the intended aim, since by virtue of the particular actuation of the main piston during the rapid advancement step it obtains higher part approach speeds with respect to conventional combined pneumatic-hydraulic press heads with an equal pneumatic power, thus reducing treatment dead times with a consequent increase in the productive potentiality of the press.

In other words, the actuation times depend only on the capacity of the pneumatic feed ducts which move the auxiliary piston and the actuation piston.

A further advantage is that said head has a structure which is simple to execute.

The press head thus conceived is susceptible to numerous modifications and variations, all of which are within the scope of the inventive concept; all the details may furthermore be replaced with technically equivalent elements.

In practice, the materials employed, as well as the dimensions, may be any according to the requirements and the state of the art.

We claim:

1. Combined pneumatic-hydraulic press head comprising;

a body (2, 33);

a main chamber (3, 36) defined in said body (2, 33) and having a main chamber axis (3*a*, 44), said main chamber (3, 36) having one end (6) and another end (12);

a main piston (4, 37) axially slideably accommodated inside said main chamber (3, 36) and having a stem (4a, 38), said stem (4a, 38) protruding from said one end (6);

a secondary piston (5, 43) located in said main chamber (3, 36) between said other end (12) and said main piston (4, 37);

a first end chamber (14, 39) defined between said main piston (4, 37) and said one end (6);

a second end chamber (15, 41) defined between said secondary piston (5, 43) and said other end (12);

an intermediate chamber (16) delimited by said main piston (4, 37) and said secondary piston (5, 43) and being filled with liquid;

first port means (17, 51) connected to said first end chamber (14, 39);

second port means (18, 45) connected to said second end chamber (15, 41) whereby pressurized fluid introduced therein acts directly on said secondary piston (5, 43), said first port means (17, 51) and said second port means (18, 45) being selectively connectable to a source of pressurized fluid and to the atmosphere for moving said secondary piston (5, 43), said liquid and said main piston (4, 37) along said main chamber (3, 36), whereby to rapidly move said stem (4a, 38) for positioning proximate to a workpiece (8);

a partition (20) provided in said intermediate chamber (16, 40) and having defined therein a passage (21, 42), and;

an actuation stem (19, 46) penetrating said second end chamber (15, 41), said secondary piston (5, 43) and said intermediate chamber (16, 40), said actuation stem (19, 46) being axially movable towards said passage (21, 42) with simultaneous return movement of said secondary piston (5, 43) to said other end (12) of said second end chamber (15, 41), said actuation stem (19, 46) being further axially movable into sliding sealing engagement with said passage (21, 42) for axially penetrating said intermediate chamber (16, 40) between said partition (20) and said main piston (4, 37), whereby to increase pressure in said liquid contained therein with corresponding actuation of said stem (4a, 38) for pressing a workpiece (8), wherein said pneumatic-hydraulic press head further comprises valve means (30, 31) provided in said secondary piston (5).

2. Combined pneumatic-hydraulic press head according to claim 1, wherein said valve means (30, 31) include a valve needle (31), said valve needle (31) protruding from said secondary piston (5, 43), said valve means (30, 31) being openable upon contact of said valve needle (31) with said other end (12) of said main chamber (3, 36).

3. Combined pneumatic-hydraulic press head comprising;

a body (2, 33);

a main chamber (3, 36) defined in said body (2, 33) and having a main chamber axis (3a, 44), said main chamber (3, 36) having one end (6) and another end (12);

a main piston (4, 37) axially slideably accommodated inside said main chamber (3, 36) and having a stem (4a, 38), said stem (4a, 38) protruding from said one end (6);

a secondary piston (5, 43) located in said main chamber (3, 36) between said other end (12) and said main piston (4, 37);

a first end chamber (14, 39) defined between said main piston (4, 37) and said one end (6);

a second end chamber (15, 41) defined between said secondary piston (5, 43) and said other end (12);

an intermediate chamber (16) delimited by said main piston (4, 37) and said secondary piston (5, 43) and being filled with liquid;

first port means (17, 51) connected to said first end chamber (14, 39);

second port means (18, 45) connected to said second end chamber (15, 41) whereby pressurized fluid introduced therein acts directly on said secondary piston (5, 43), said first port means (17, 51) and said second port means (18, 45) being selectively connectable to a source of pressurized fluid and to the atmosphere for moving said secondary piston (5, 43), said liquid and said main piston (4, 37) along said main chamber (3, 36), whereby to rapidly move said stem (4a, 38) for positioning proximate to a workpiece (8);

a partition (20) provided in said intermediate chamber (16, 40) and having defined therein a passage (21, 42);

an actuation stem (19, 46) penetrating said second end chamber (15, 41), said secondary piston (5, 43) and said intermediate chamber (16, 40), said actuation stem (19, 46) being axially movable towards said passage (21, 42) with simultaneous return movement of said secondary piston (5, 43) to said other end (12) of said second end chamber (15, 41), said actuation stem (19, 46) being further axially movable into sliding sealing engagement with said passage (21, 42) for axially penetrating said intermediate chamber (16, 40) between said partition (20) and said main piston (4, 37), whereby to increase pressure in said liquid contained therein with corresponding actuation of said stem (4a, 38) for pressing a workpiece (8);

an actuation chamber (23, 48) defined in said body (2, 33) coaxially to said second end chamber (15, 41), and;

an actuation piston (22, 47) slideably accommodated in said actuation chamber (23, 48) and being connected to said actuation stem (19, 46);

wherein said actuation chamber (23, 48) is sealingly separated from said second end chamber (15, 41) and has formed therein a first actuation port (24, 50) and a second actuation port (25, 49), said first actuation port (24, 50) being located between said actuation piston (22, 47) and an end of said actuation chamber (23, 48) proximate to said second end chamber (15, 41), said second actuation port (25, 49) being located between said actuation piston (22, 47) and an end of said actuation chamber (23, 48) remote from said second end chamber (15, 41), wherein said pneumatic-hydraulic press head further comprises valve means (30, 31) provided in said secondary piston (5).

4. Combined pneumatic-hydraulic press head according to claim 5, wherein said valve means (30, 31) include a valve needle (31), said valve needle (31) protruding from said secondary piston (5, 43), said valve mans (30, 31) being openable upon contact of said valve needle (31) with said other end (12) of said main chamber (3, 36).

5. Combined pneumatic-hydraulic press head comprising;

a body (2, 33);

a main chamber (3, 36) defined in said body (2, 33) and having a main chamber axis (3a, 44), said main chamber (3, 36) having one end (6) and another end (12);

a main piston (4, 37) axially slideably accommodated inside said main chamber (3, 36) and having a stem (4a, 38), said stem (4a, 38) protruding from said one end (6);

a secondary piston (5, 43) located in said main chamber (3, 36) between said other end (12) and said main piston (4, 37);

a first end chamber (14, 39) defined between said main piston (4, 37) and said one end (6);

a second end chamber (15, 41) defined between said secondary piston (5, 43) and said other end (12);

an intermediate chamber (16) delimited by said main piston (4, 37) and said secondary piston (5, 43) and being filled with liquid;

first port means (17, 51) connected to said first end chamber (14, 39);

second port means (18, 45) connected to said second end chamber (15, 41) whereby pressurized fluid introduced therein acts directly on said secondary piston (5, 43), said first port means (17, 51) and said second port means (18, 45) being selectively connectable to a source of pressurized fluid and to the atmosphere for moving said secondary piston (5, 43), said liquid and said main piston (4, 37) along said main chamber (3, 36), whereby to rapidly move said stem (4a, 38) for positioning proximate to a workpiece (8);

a partition (20) provided in said intermediate chamber (16, 40) and having defined therein a passage (21, 42);

an actuation stem (19, 46) penetrating said second end chamber (15, 41), said secondary piston (5, 43) and said intermediate chamber (16, 40), said actuation stem (19, 46) being axially movable towards said passage (21, 42) with simultaneous return movement of said secondary piston (5, 43) to said other end (12) of said second end chamber (15, 41), said actuation stem (19, 46) being further axially movable into sliding sealing engagement with said passage (21, 42) for axially penetrating said intermediate chamber (16, 40) between said partition (20) and said main piston (4, 37), whereby to increase pressure in said liquid contained therein with corresponding actuation of said stem (4a, 38) for pressing a workpiece (8);

an actuation chamber (23, 48) defined in said body (2, 33) coaxially to said second end chamber (15, 41) and being sealingly separated from said second end chamber (15, 41);

an actuation piston (22, 47) slideably accommodated in said actuation chamber (23, 48) and being connected to said actuation stem (19, 46);

a first actuation port (24, 50) formed in said actuation chamber (23, 48) and being located between said actuation piston (22, 47) and an end of said actuation chamber (23, 48) proximate to said second end chamber (15, 41);

a second actuation port (25, 49) formed in said actuation chamber (23, 48) and being located between said actuation piston (22, 47) and an end of said actuation chamber (23, 48) remote from said second end chamber (15, 41), and;

valve means (30, 31) provided in said secondary piston (5), said valve means (30, 31) including a valve needle (31), said valve needle (31) protruding from said secondary piston (5, 43), said valve means (30, 31) being openable upon contact of said valve needle (31) with said other end (12) of said main chamber (3, 36).

6. Combined pneumatic-hydraulic press head according to claim 3, wherein said main chamber (3), said main piston (4), said stem (4a, 38), said secondary piston (5), said first end chamber (14), said second end chamber (15), said actuation stem (19), said passage (21) and said intermediate chamber (16) are axially aligned with said main chamber axis (3a).

7. Combined pneumatic-hydraulic press head according to claim 3, wherein said main chamber (3, 36), said main piston (37), said stem (38) and said first end chamber (39) are coaxial with said main chamber axis (44), and wherein said secondary piston (43), said actuation stem (46), said passage (42) and said second end chamber (41) are transverse to said main chamber axis (44).

8. Combined pneumatic-hydraulic press head according to claim 6, wherein said main piston (4) has formed therein a depression (26), said depression (26) facing said actuation stem (19), said actuation stem (19) being partially accommodatable in said depression (26) of said main piston (4).

* * * * *